US008049128B1

(12) United States Patent
Witt

(10) Patent No.: US 8,049,128 B1
(45) Date of Patent: Nov. 1, 2011

(54) POWER HAND TOOL SWITCH TORQUE CONTROLLER APPARATUS

(76) Inventor: Daniel D. Witt, Chilton, WI (US)

( * ) Notice: Subject to any disclaimer, the term of this patent is extended or adjusted under 35 U.S.C. 154(b) by 389 days.

(21) Appl. No.: 12/381,142

(22) Filed: Mar. 9, 2009

(51) Int. Cl.
*H01H 13/02* (2006.01)

(52) U.S. Cl. ..... 200/522; 200/334

(58) Field of Classification Search ..... 200/522, 200/334; 338/68
See application file for complete search history.

(56) References Cited

U.S. PATENT DOCUMENTS 2,810,051 A * 10/1957 Johnson ..... 200/318
3,117,206 A * 1/1964 Bush ..... 200/510
3,194,898 A * 7/1965 Thomas ..... 200/4
4,097,703 A 6/1978 Houser
4,572,997 A * 2/1986 Yamanobe et al. ..... 388/840
5,012,057 A 4/1991 Inuyama
5,165,531 A 11/1992 Kawakami et al.
5,380,971 A * 1/1995 Bittel et al. ..... 200/536
5,401,928 A * 3/1995 Kelley ..... 200/510
6,469,268 B1 * 10/2002 Schaeffeler et al. ..... 200/522
7,511,240 B2 * 3/2009 Inagaki et al. ..... 200/522

* cited by examiner

*Primary Examiner* — Elvin G Enad
*Assistant Examiner* — Lisa Klaus
(74) *Attorney, Agent, or Firm* — Robert T. Johnson

(57) ABSTRACT

This invention is for a trigger switch apparatus for a hand held electric drill and includes a control of the electric power to a drill for fast or slow rotation of the drill bit by moving a rheostat contact bridge over a rheostat coil section for control of the rotation speed of the drill bit, and further a leaf spring holds the trigger carriage stop shoulder onto the carriage, and on seizure, kick back or sudden torque of the drill bit there is a cut off of power and the switch reverts to an "off" or "open" position, which then requires re-setting of the switch to a "closed" or "on" position for re-actuating operation of the hand held electric drill.

1 Claim, 6 Drawing Sheets

POWER HAND TOOL SWITCH TORQUE CONTROLLER APPARATUS

BACKGROUND OF THE INVENTION

This invention pertains in particular to electric power hand held drill apparatus, having a safety switch for immediate "off" when the hand held electric drill at the "on" position encounters a problem of stalling, causing a kick back, sudden torque or twist of the hand held electric drill and the kick back torque or twisting causing an immediate disconnect from "on" to the "off" position of the power to the handheld electric drill.

SUMMARY OF THE INVENTION

This invention includes a switch assembly having a finger actuated trigger with an electrical contactor attached to a shaft extending from the trigger and the electrical contact riding on an electrical coil as part of the switch electrical circuit, and a leaf spring to hold the electrical contact in the "on" position but shifting to the "off" position on kick back or torque or twisting of the hand held electric drill

BACKGROUND INFORMATION SUBJECT MATTER IN U.S. PATENTS

U.S. Pat. No. 4,097,703 for TRIGGER SWITCH.
U.S. Pat. No. 4,572,997 for TRIGGER SWITCH.
U.S. Pat. No. 5,012,057 for TRIGGER SWITCH.
U.S. Pat. No. 5,165,531 for TRIGGER SWITCH.

None of the above background information individually would anticipate, or collectively make obvious this present invention as disclosed and/or claimed.

BRIEF DESCRIPTION OF DRAWINGS

| FIGURE NUMBER | DESCRIPTION |
|---|---|
| 1 | Side elevation view of switch apparatus mounted in electric hand drill. |
| 2. | Expanded plan view of switch components prior to assembly. |
| 3. | Assembled switch at "off" or "open" position. (plan view) |
| 4. | Cross section view of FIG. 3. at "off" or "open" position. |
| 5. | Assembled switch at "on" or "closed" position. (plan view) |
| 6. | Cross section view of FIG. 5, switch at "on" or "closed" position. |
| 7. | Enlarged view of switch at "off" or "open" position, from FIG. 1. |
| 8. | Enlarged view of switch at "on" or "closed" . |
| 9. | Plan view of switch at "off" or "open" position. |
| 10 | Enlarged view of shank of switch trigger stopped at trigger carriage catch at "off" or "open" position; from FIG. 3. |
| 11. | Enlarged view of shank of switch trigger at "off" or "open" position; from FIG. 9. |
| 12 | Enlarged section perspective view of carriage legend 3. |
| 13. | Enlarged exploded view of trigger housing apparatus segments. |

| LEGEND NO. | DESCRIPTION |
|---|---|
| 1. | Hand held electric power drill. |
| 2 | Trigger housing |
| 3. | Carriage trigger assembly. |
| 4. | Trigger. |
| 5. | Coiled trigger spring. |
| 6 | Carriage spring. |
| 7 | Rheostat contact bridge. |
| 8. | Rheostat coil |
| 9. | Power contact slide. |
| 10. | Power plug-in connector. |
| 11. | Trigger compression stop. |
| 12. | Trigger extension rod. |
| 12' | Trigger extension stop. |
| 12" | Trigger extension rod beyond trigger extension stop. |
| 13. | Trigger positioning leaf spring. |
| 14. | Trigger carriage stop shoulder. |
| 15 | Shaft ' |
| 15' | Trigger spring stop. |
| 16. | Carriage extension stop. |
| 17. | Carriage extension catch. |
| 18. | Housing cover. |
| 19, 19' | Housing cover retainers. |
| 20. | Trigger coil spring slot. |
| 21. | Live electric power lead |
| 22. | Controlled power lead. |
| 23. | Common power lead. |
| 24. | Contact bridge assembly. |
| 25. | Contact bridge leaf spring. |
| 26, 26' | Snap- in slots for attaching cover to carriage. |

DETAILED DESCRIPTION OF THIS INVENTION

Figure 1:
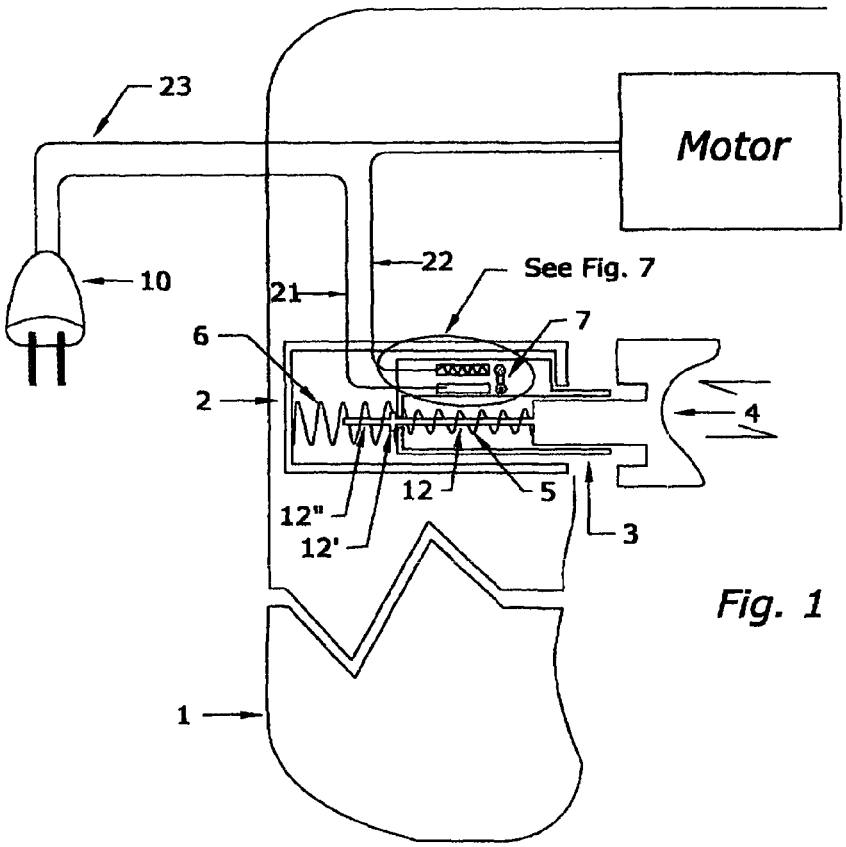

FIG. 1 is a side elevation view of electrical switch trigger (4) apparatus assembled in electric powered hand drill (1), and further showing trigger housing (2) carriage (3) trigger (4), coiled trigger spring (5) mounted around trigger extension rod (12) attached to rear of trigger (4) and a trigger extension stop (12') attached to the trigger extension rod (12). A coiled carriage spring (6) is mounted around trigger extension rod (12") extending backward beyond the extension stop (12').

Figure 2:
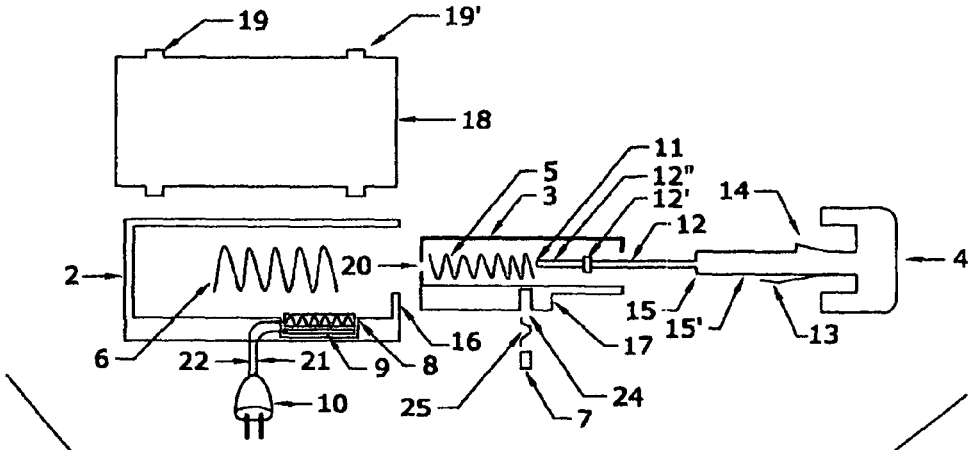

FIG. 2 is a schematic side elevation view of the assembly components of this invention, and includes the components of FIG. 1, as described above, plus rheostat contact bridge (7) rheostat coil (8), power contact slide (9) and power connector (10) to plug into power source.

Figure 3:
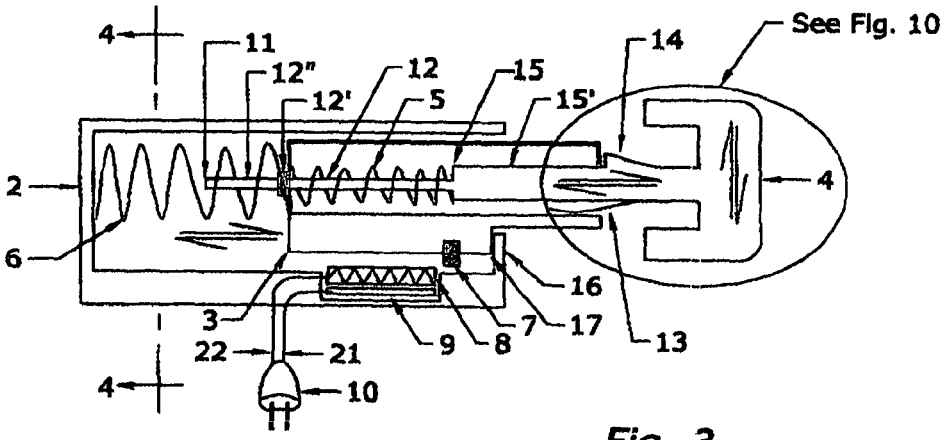

FIG. 3 is an enlarged trigger assembly with the switch in "open" or "off" position showing the same components as shown, and discussed in description of FIG. 2 above, but in addition includes trigger positioning leaf spring (13) and trigger carriage stop shoulder (14) on trigger shaft (15') and trigger spring stop (15) on the trigger shaft (15') carriage extension stop (16), and carriage extension catch (17).

Figure 4:
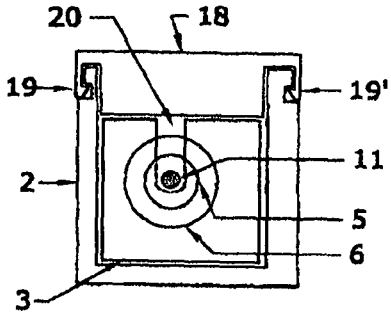
Figure 5:
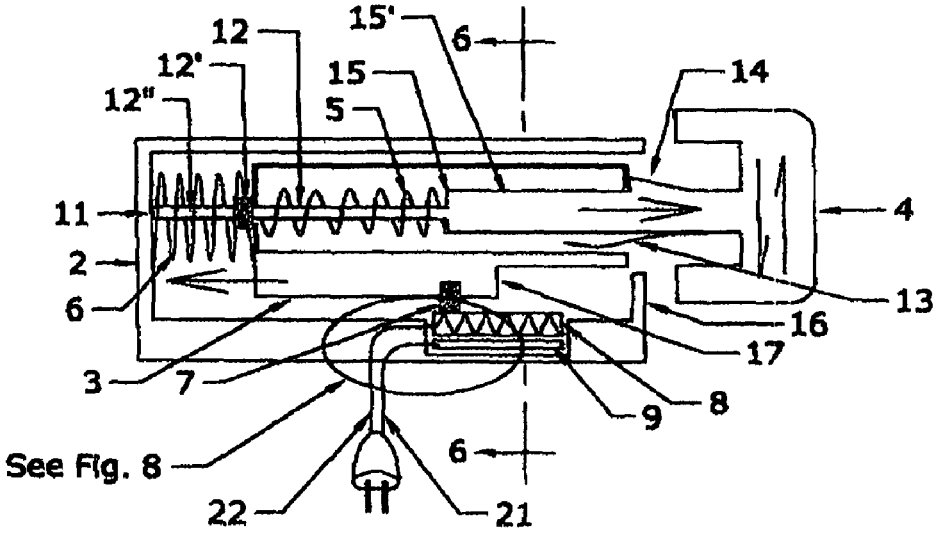

FIG. 4 is a cross section view of FIG. 3, showing trigger housing (2), and carriage (3), coiled trigger spring (5), carriage spring (6) trigger compression stop (11), housing cover (18), housing cover retainers (19), (19'), trigger spring trough (20), FIG. 5 is an enlarged trigger assembly with the switch at "closed" or "on" position showing rheostat contact bridge (7) on rheostat coil (8), and includes all the components of FIGS. 1 and 3.

Figure 6:
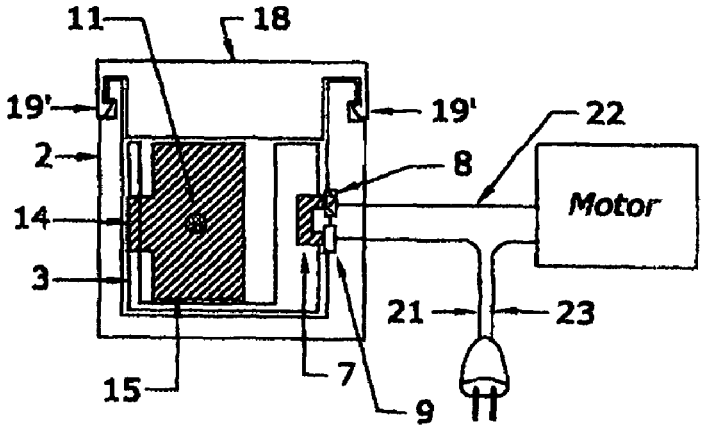

FIG. 6 is a cross section view of FIG. 5, showing trigger housing (2), carriage (3) rheostat contact bridge (7), rheostat coil (8), trigger compression stop (11), trigger carriage stop shoulder (14), trigger shaft (15), housing cover (18), housing cover retainers (19), (19'), power plug in connector (10)

Figure 7:
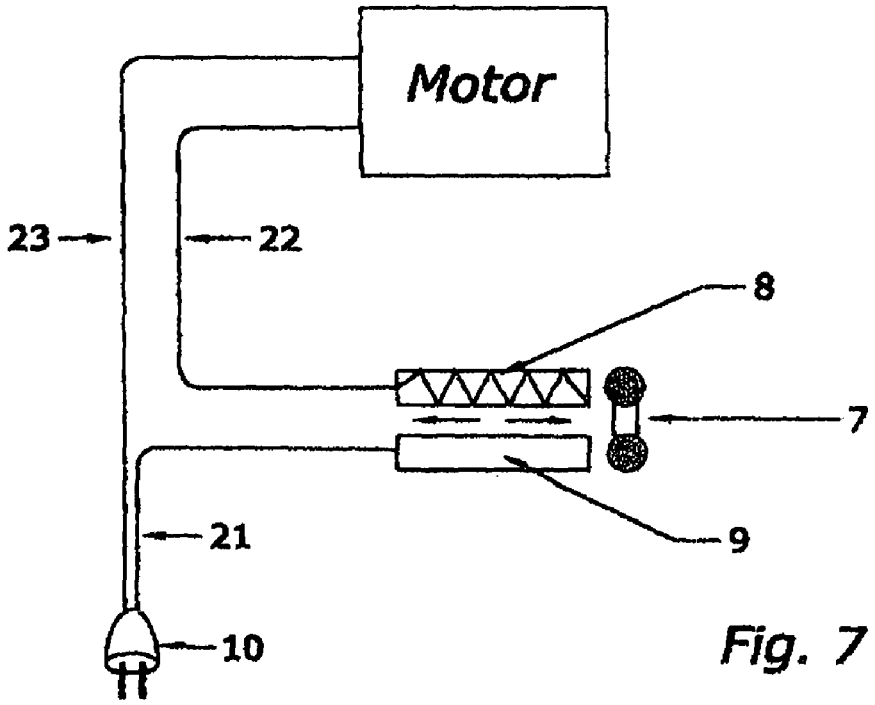

FIG. 7. is a schematic enlargement of the electric circuitry of the switch of FIG. 3, at the "open" or "off" position and includes rheostat contact bridge (7) movable by trigger 4 action; Rheostat coil (8), power contact slide (9) power plug in connector (10) live current lead (21), controlled current lead (22) and common current lead (23). Leads (22) and (23) power feed to motor.

Figure 8:
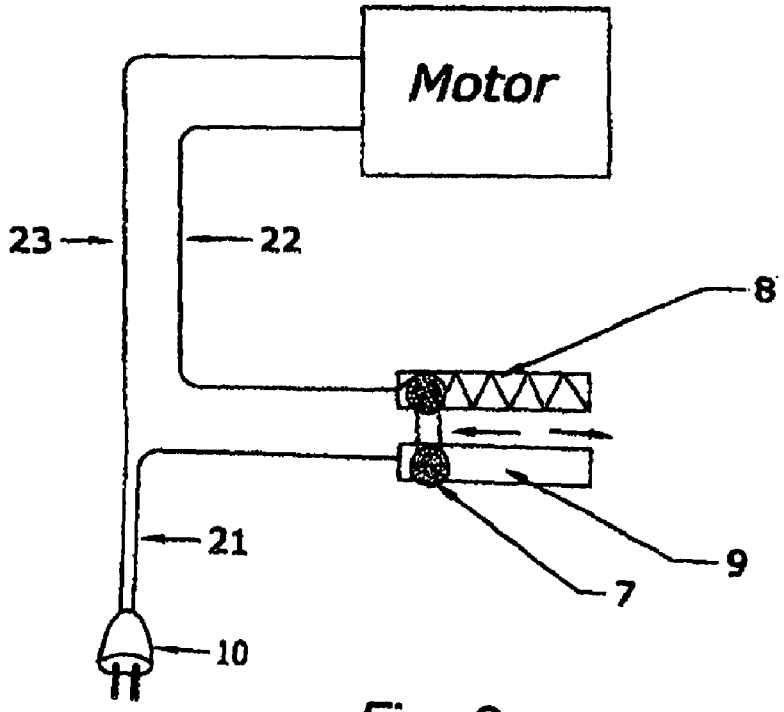

FIG. 8 is a schematic enlargement of the electric circuitry of the switch of FIG. 5 at the "closed" or "on" position and includes the rheostat contact bridge (7) movable by trigger (4) action; Rheostat coil (8), power contact slide (9), power plug in connector (10) live current lead (21), controlled current lead (22), common current lead (23), Leads (22) and (23) power lead to motor.

Figure 9:
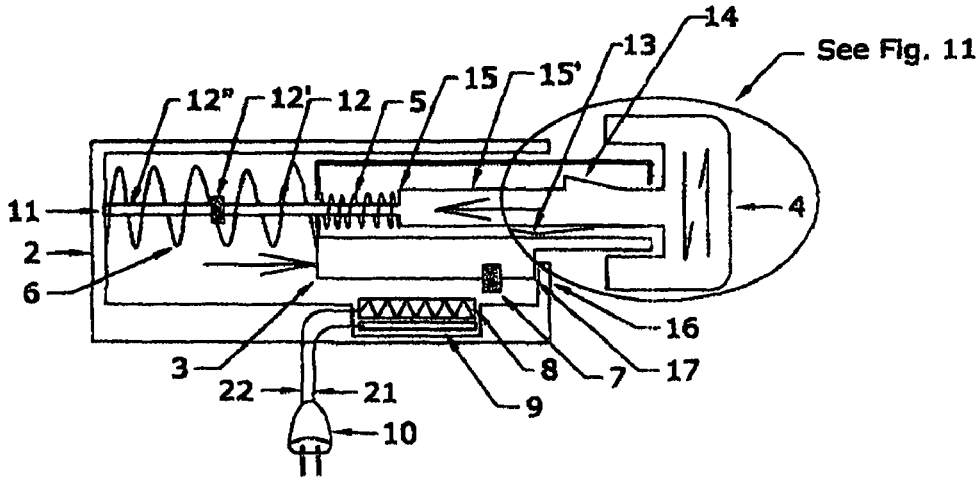

FIG. 9, is a side elevation view of switch assembly in "open" or "off" position and trigger carriage stop shoulder (14) passed through opening in front end of carriage (3) disabling "closing" or turning switch to "closed" or "on" position.

Figure 10:
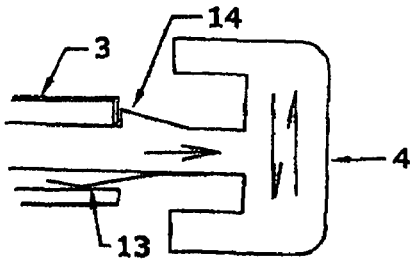

FIG. 10 is enlarged section of trigger (4) referred to in FIG. 3, showing trigger carriage stop shoulder (14) in contact with carriage open end wall of carriage (3).

Figure 11:
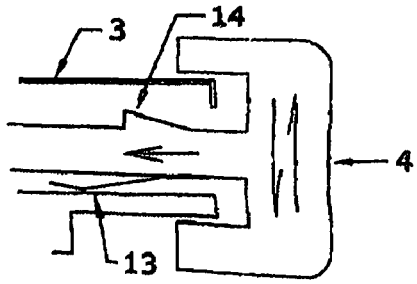

FIG. 11 is enlarged section of trigger (4) as referred to in FIG. 9, showing trigger shoulder (14) extending into carriage (3) to disable turning switch to the "closed" or "on" position.

FIGS. 1, 3, 5, 7, 8, 9, 10, and 11, show bi-directional arrows for movement of the trigger segment for on/off switch in both elevation and plan view.

Figure 12:
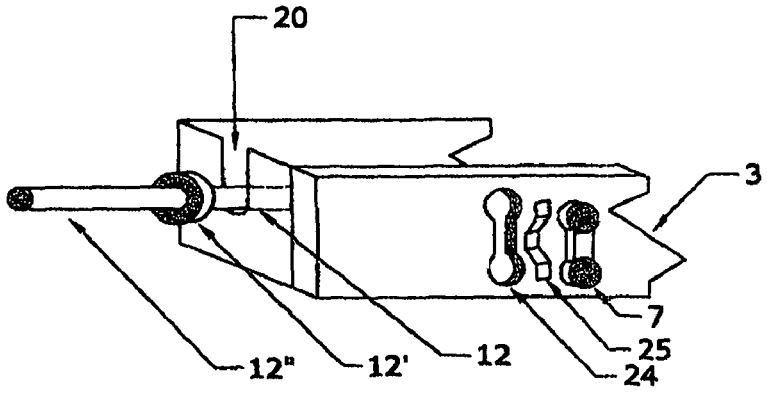

Referring now to FIG. 12 which is described as "Enlarged section perspective view of carriage legend 3," and includes rheostat contact bridge 7, trigger extension rod 12, riding in trigger coil spring slot 20, trigger extension, stop 12', trigger extension rod 12" extending beyond slot 20.

Figure 13:
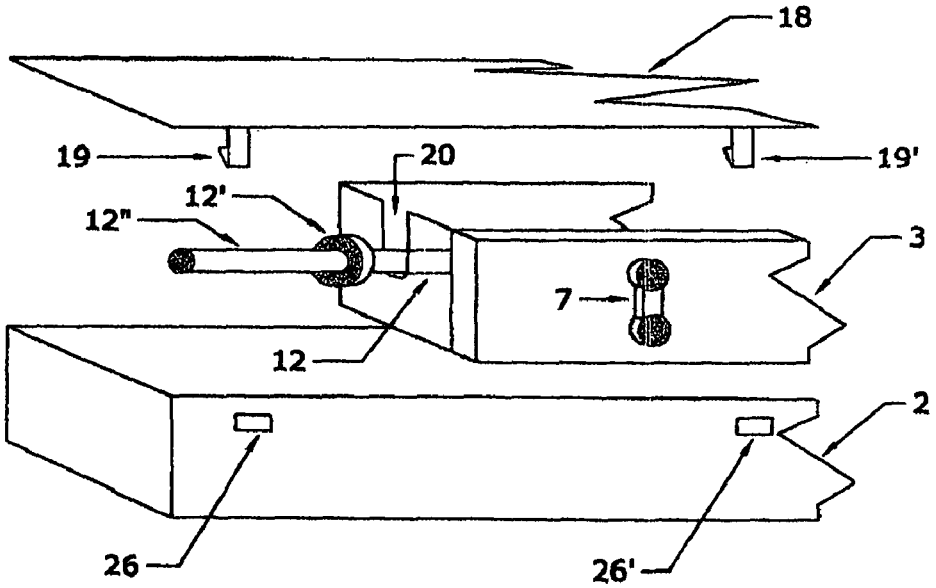

FIG. 13 is an "enlarged exploded view of trigger housing apparatus segments" and includes a cover 18 for attachment to trigger housing 2, by means of housing cover retainers 19, 19' snapped into snap in slots 26, 26' for attaching the housing cover 18, to trigger housing 2.

Having described my invention I claim:

1. A power hand tool switch torque control apparatus in a hand held electric power drill, said switch torque control apparatus consisting of:

a—trigger and a trigger extension rod attached to said trigger, b—a trigger extension rod extending into a carriage, and said carriage to reciprocate in a trigger housing, c—a coiled spring in said trigger housing and said coiled spring contacts a closed end of said trigger housing and the end of said carriage, d—a coiled trigger spring in said carriage, and said coiled trigger spring in said carriage extends from inner end of said carriage to a trigger spring stop on a trigger shaft, e—electric power line enters the electric power drill via one line to control current lead rheostat coil and another line of common current lead to electric motor drive, f—a rheostat contact bridge mounted on said carriage to contact said rheostat coil, g—a carriage extension catch mounted on said carriage and a carriage extension stop mounted on said trigger housing, h—a trigger carriage stop shoulder on a shaft from said trigger, i—a leaf spring mounted on said shaft from said trigger, and said leaf spring in contact with said carriage.

* * * * *